US006823760B1

(12) United States Patent
Kilduff

(10) Patent No.: US 6,823,760 B1
(45) Date of Patent: Nov. 30, 2004

(54) CORK EXTRACTOR

(75) Inventor: Ed Kilduff, New York, NY (US)

(73) Assignee: Metrokane, Inc., New York, NY (US)

( * ) Notice: Subject to any disclaimer, the term of this patent is extended or adjusted under 35 U.S.C. 154(b) by 0 days.

(21) Appl. No.: 10/284,256

(22) Filed: Oct. 31, 2002

(51) Int. Cl.[7] ..... B67B 7/62

(52) U.S. Cl. ..... 81/3.37; 81/3.2; 81/3.25; 81/3.36

(58) Field of Search ..... 81/3.55, 3.37, 81/3.2, 3.36, 3.29, 3.47, 3.48

(56) References Cited

U.S. PATENT DOCUMENTS 1,753,026 A * 4/1930 Rosati ..... 81/3.37
4,063,473 A * 12/1977 Bozzo ..... 81/3.37
4,399,720 A * 8/1983 Cuppett ..... 81/3.37
5,000,063 A * 3/1991 Federighi, Sr. ..... 81/3.37
5,864,939 A * 2/1999 In-Seok ..... 29/509
5,934,160 A * 8/1999 Gibson ..... 81/3.37
6,151,992 A 11/2000 Larimer
2002/0092169 A1 7/2002 Kilduff

* cited by examiner

*Primary Examiner*—Lee D. Wilson
(74) *Attorney, Agent, or Firm*—Millen, White, Zelano & Branigan, P.C.

(57) ABSTRACT

A winged corkscrew has a lock box that prevents a non-stick coated worm from turning in a reverse direction and slipping out of a cork when two wings of the corkscrew are closed. The lock box locks onto a collar on a main shaft of the cork screw, and thereafter, a cam on the main shaft forms a one way rotational ratchet with the lock box. When the worm is fully inserted, the wings are lowered to remove the cork, but the ratchet prevents the worm from turning in reverse and slipping out of the cork. The corkscrew also has catches that center the corkscrew on the bottle and align the worm into the center of the cork. After the cork has been removed from the bottle, the lock box is unlocked to allow the cork to be removed.

35 Claims, 11 Drawing Sheets

CORK EXTRACTOR

BACKGROUND OF THE INVENTION

1. Field of the Invention

The present invention relates to winged corkscrews having non-stick coated worms. In particular, the invention relates to mechanisms that prevent the worm from turning in a reverse direction and slipping out of a cork when a user attempts to remove the cork.

2. Description of Related Art

Winged corkscrews conventionally include a worm, which may be in the form of a wire wound helically about an axis, having a point at a lower end for initial insertion into a cork and having a handle at the upper end to aid rotation. The corkscrew conventionally has two similar wings (sometimes called arms) extending symmetrically outwardly on opposite sides of the axis and engagingly attached to rings about the axis. As the worm is inserted into the cork, the rings move downward with the worm and the wings are raised upwards. Then, to remove the cork from the bottle, the wings are lowered to their original position against the corkscrew, thus raising the worm and the cork.

In order for the worm to more smoothly enter the cork and to minimize the possibility that the cork might crumble, the worm may be enameled or coated with a non-stick surface coat, such as Teflon™. However, if the worm is slick-coated, when the wings of the corkscrew are lowered, the worm may turn in a reverse direction and slip out of the cork without raising the cork from the bottle. Furthermore, known corkscrews lack a means to center the worm on diverse size bottle necks that may come in various bottle neck diameters. As a result, the worm sometimes obliquely enters a cork or enters the cork at an offset. A cork is likely to be broken or crumbled when the worm enters at an oblique angle or an offset axis.

SUMMARY OF THE INVENTION

The present invention prevents a non-stick coated worm from slipping out of a cork when the cork is pulled from the bottle and also helps to center the corkscrew onto the bottle and align the worm in the center of the cork. The term "cork" as used here means any bottle stopper material that may be used as a cork.

An improved winged corkscrew has a lock box that prevents a non-stick coated worm from turning in a reverse direction and slipping out of a cork when wings of the corkscrew are closed to raise the cork. In one example of the operation of the invention, the lock box locks onto a collar on a main shaft of the cork screw. In another example of the operation of the invention, a cam on the main shaft forms a one way rotational ratchet with the lock box. When the worm is fully inserted, the wings are lowered to remove the cork, but the ratchet prevents the worm from turning in reverse and slipping out of the cork. In another example of the invention, the corkscrew has catches that are fitted to ordinarily accept small bottle necks, but have the flexibility to enlarge to accept wide bottle necks. This helps to center the corkscrew on the bottle and align the worm into the center of the cork. After the cork has been removed from the bottle, the lock box is unlocked to allow the cork to be removed.

BRIEF DESCRIPTION OF DRAWINGS

The invention will be described in detail in the following description of preferred embodiments with reference to the following figures wherein.

DETAILED DESCRIPTION OF PREFERRED EMBODIMENTS

Figure 1:
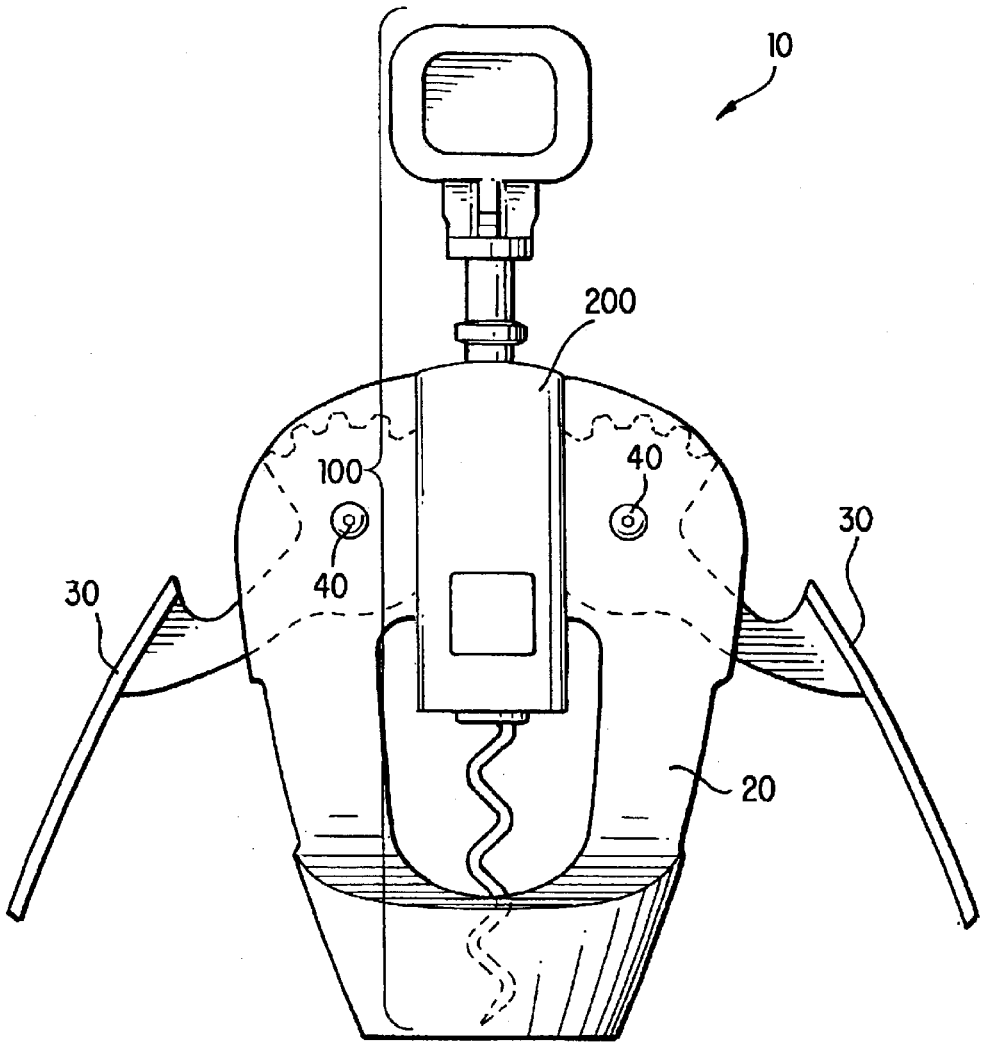
FIG. 1 is a front view of a corkscrew.

In FIG. 1, a corkscrew 10 has a body 20, a main shaft 100, two wings 30, two hinge axles 40, and a lock box 200. The body 20 of the corkscrew 10 may be plastic or metal and may be wholly formed or may be formed in several pieces which are attached together, such as by screws.

Figure 2:
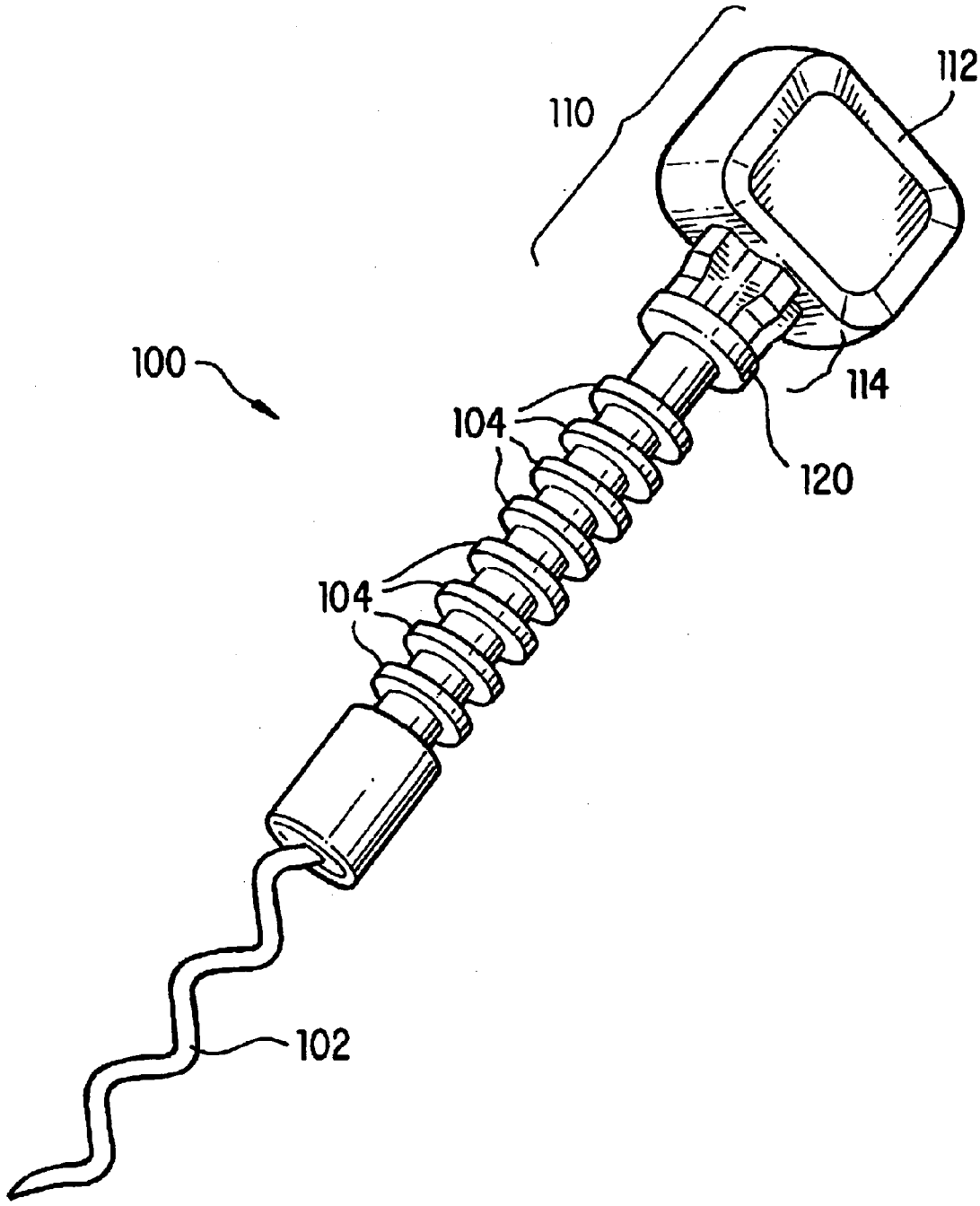
FIG. 2 is a perspective view of the main shaft of the corkscrew.
Figure 3:
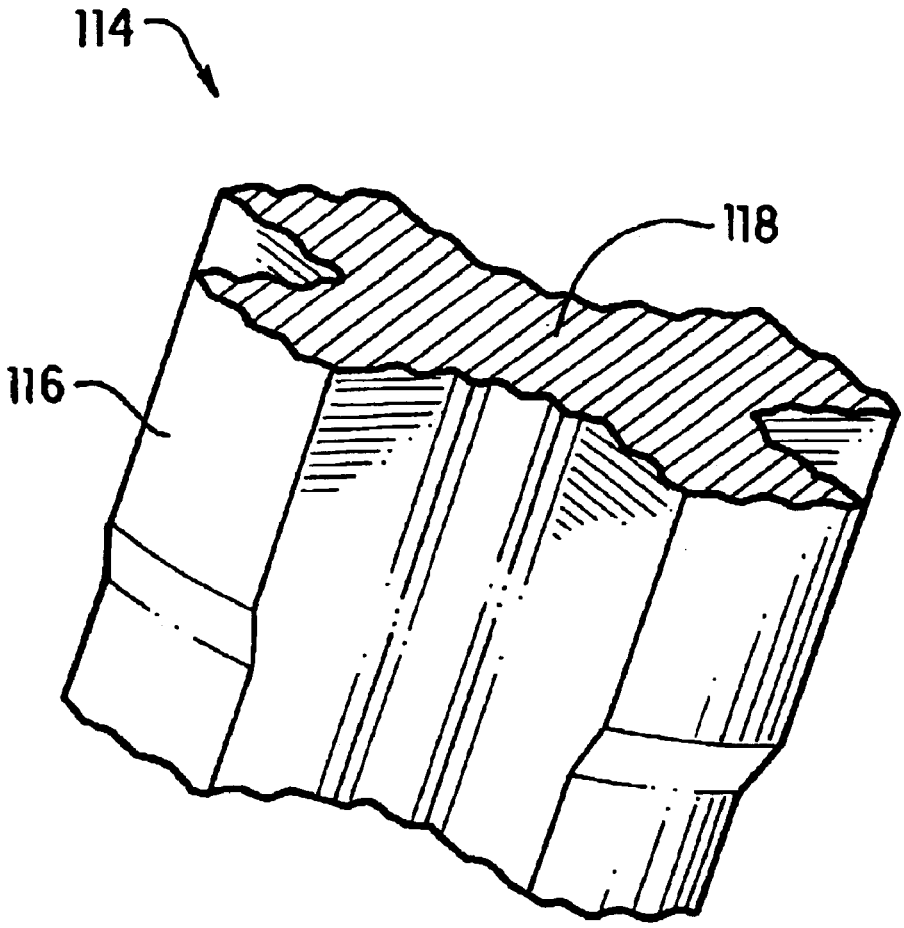
FIG. 3 is a section view of the cam portion of the main shaft.

An example of a main shaft 100 that includes a collar 120 is depicted in FIG. 2. In FIG. 2, the main shaft 100 of the corkscrew 10 includes a collar 120, and on one side of the collar 120, a cam 114. Preferably, on a side of the cam 114 that is distal to the collar 120, a knob 112 is located at one end of the main shaft 100. Preferably on the other side of the collar 120, the main shaft 100 has several ridges 104 along a length of the main shaft as well as a worm 102 on an end. The worm 102 is a helically shaped wire, has a sharp end, and is preferably non-stick coated, typically by Teflon™, or equivalent, to easily penetrate a cork. The worm 102 may be integral with the entire main shaft 100 or may be attached, such as by wedging, gluing, or an equivalent. The collar 120 preferably has a larger diameter than the diameter of the ridges 104. The cam 114 has several cam crowns 116 (see FIG. 3) which extend from the center 118 of the main shaft 100 but do not extend as far as the edge of the collar 120. The knob 112 is a handle for the corkscrew and may be in a decorative shape, for example in a substantially rectangular or oval shape, and may include indicia such as a trade name or trademark or an advertisement.

Figure 4:
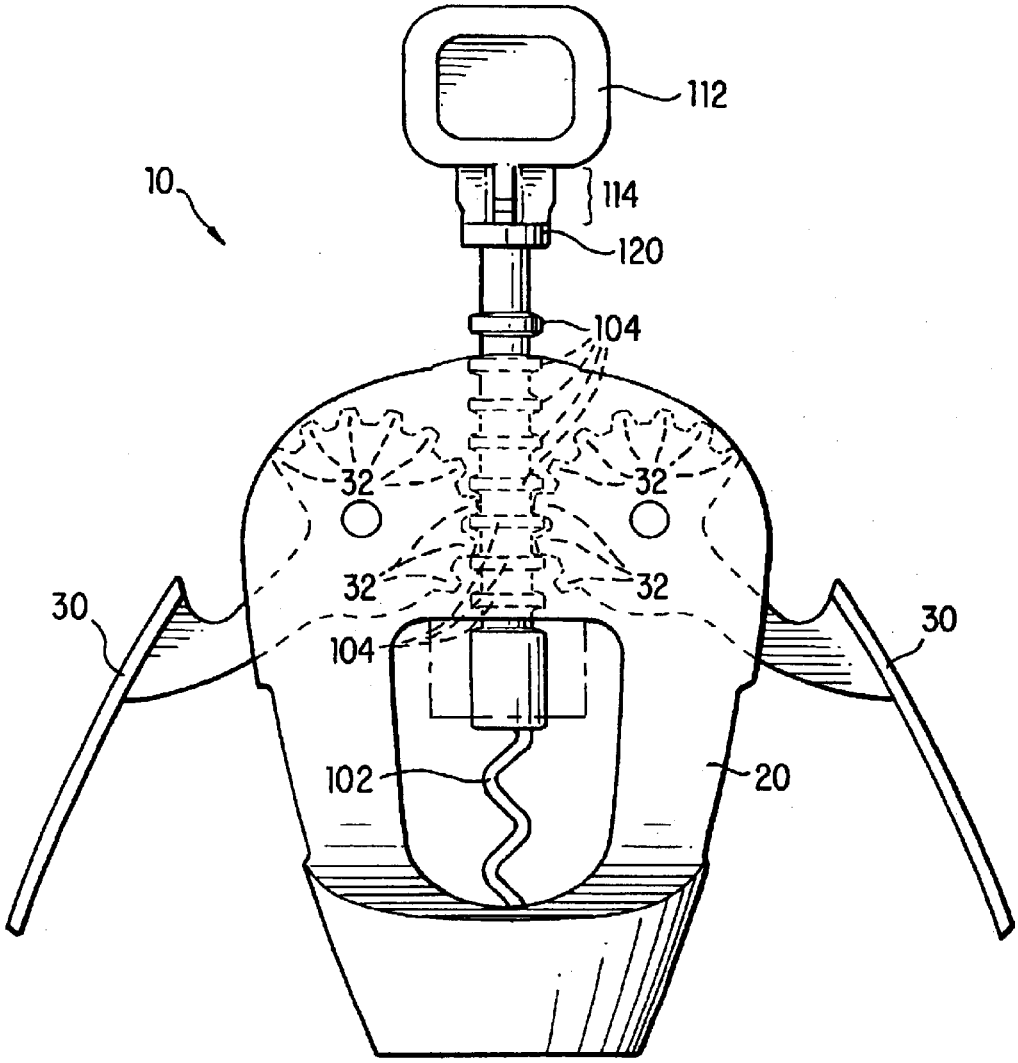
FIG. 4 is a front view of the corkscrew showing the interaction of the main shaft and the wing teeth.
Figure 5:
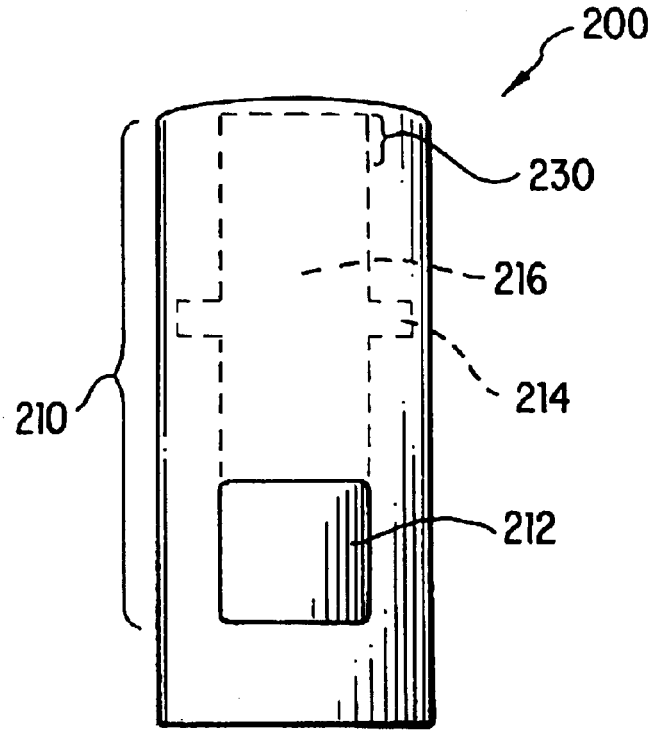
FIG. 5 is a front view of the lock box.

In FIG. 4, each wing 30 has several wing teeth 32 which extend into spaces between the ridges 104 of the main shaft 100, allowing the wings 30 and the main shaft 100 to move reciprocally. The wings 30 advantageously interact with the ridges 104 of the main shaft 100 such that when the main shaft 100 moves axially, then the wings 30 rotate as well, and vice versa. The wings 30 are attached to the body 20 by the hinge axles 40.

Figure 7:
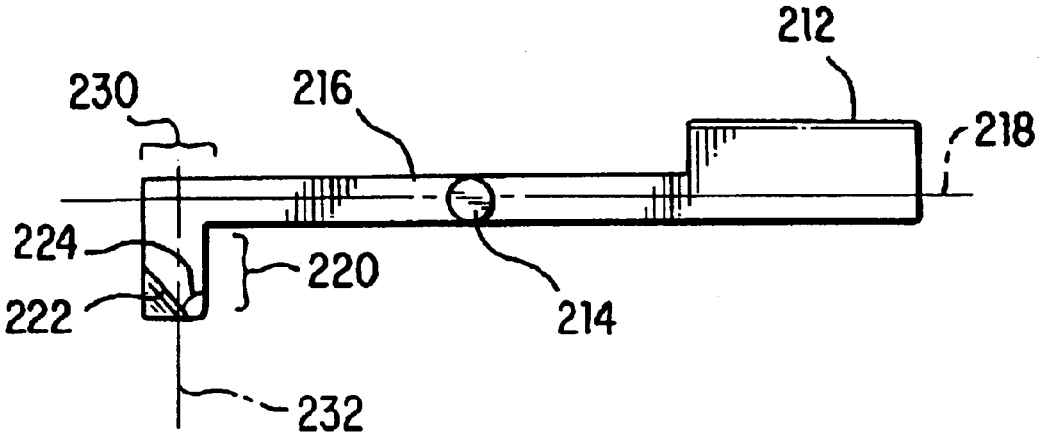
FIG. 7 is a side view of the main lever of the lock box.
Figure 8:
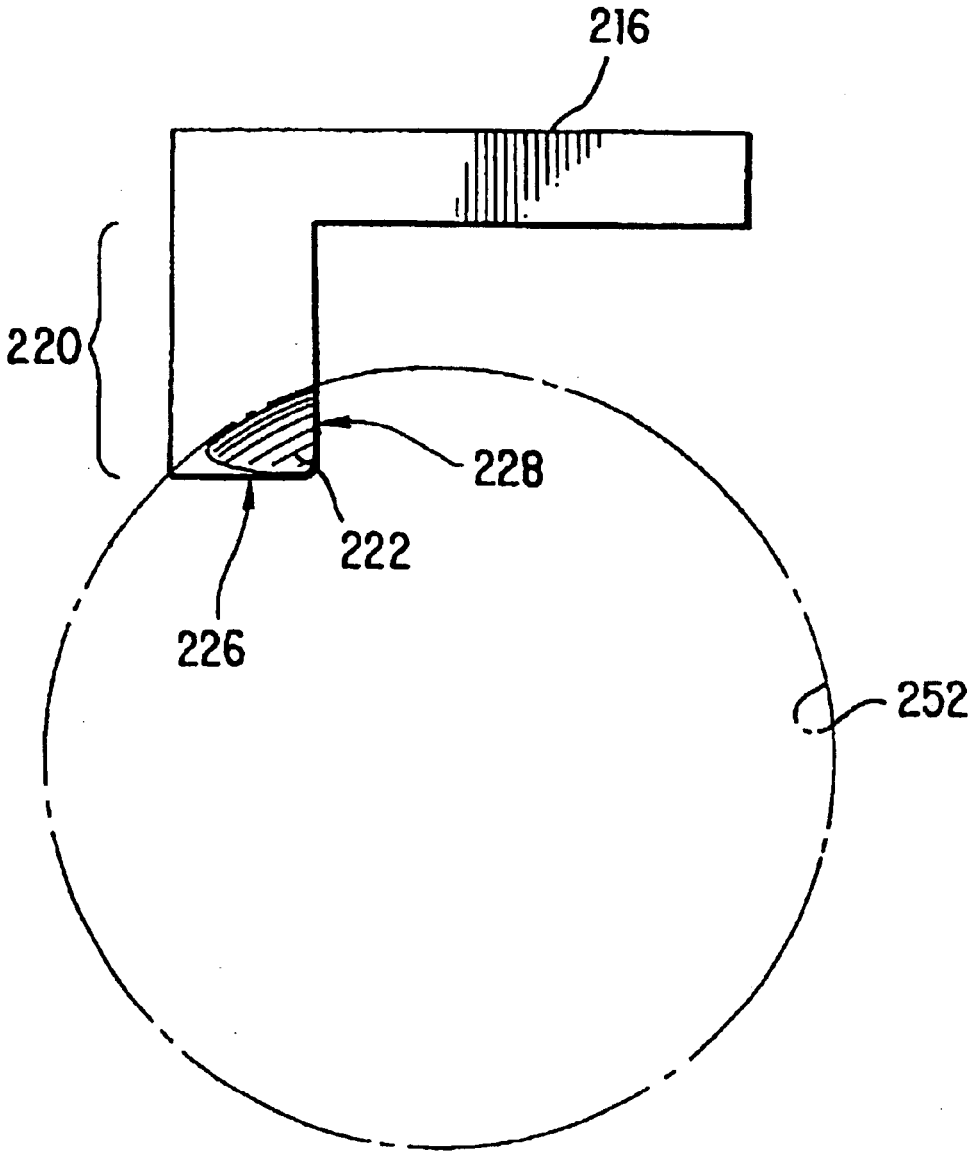
FIG. 8 is a side view of the protruding portion of the main lever of the lock box.
Figure 9:
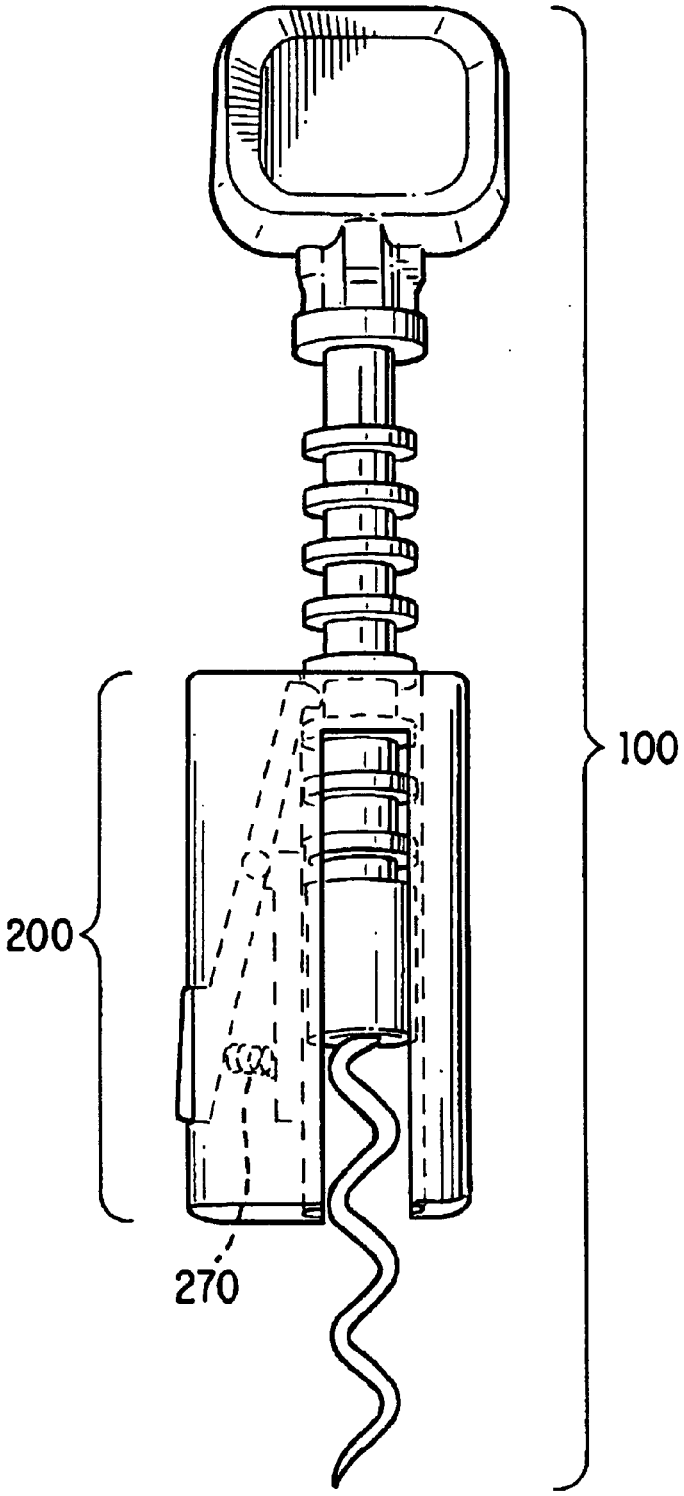
FIG. 9 is side view of the lock box showing the interaction of the main shaft and the protruding portion.

An example of the lock box 200 as it interacts with the collar 120 and the cam 114 is depicted in FIGS. 5-9. In FIGS. 5-9, the lock box 200 has a main lever 210 installed in box housing 250. The main lever 210 includes a button 212, an end portion 230 and a lever 216 (between the end portion 230 and the button 212) that pivots around a pivot 214. The pivot 214 may be part of the lever 216 or may be attached to the lever 216. On one end of the main lever 210 is a button 212 that extends out of the box housing 250 of lock box 200. The button 212 is arranged so that, when operated, it presses against a spring 270 that is, in this example, disposed between button 212 and a portion of the box housing 250 (see FIG. 9). The spring 270 may be a spiral compression spring, leaf spring, resilient material, a torsion spring, or an equivalent, and the exact location of the spring may be corresponding relocated based on spring type. On the other end of the main lever 210 is an end portion 230 (see FIG. 7). The spring 270 holds the button 212 in an ordinarily raised position as depicted in FIG. 9, and holds the end portion 230 of the main lever 210 in an ordinarily lowered position as also depicted in FIG. 9.

In FIG. 7, two axes of the main lever 210 are defined to be a lever axis 218 and a transverse axis 232. In the end portion 230, a protruding portion 220 extends along the transverse axis 232 and interacts with the collar 120 of the main shaft 100 as further discussed below. The protruding portion 220 has a chamfered bevel 222 on a distal side of portion 220 and a substantially right angle 224 (lateral view angle 224), on a proximal side of portion 220 (see FIG. 7). The chamfered bevel 222 is angled to allow the collar 120 of the main shaft 100 to pass by the protruding portion 220 in one direction (i.e., inserting the worm into the cork), while the lateral view angle 224 is angled to resist the collar 120 from passing the protruding portion 220 in the opposite direction (i.e., removing the worm from the cork).

In operation, as the worm 104 turns into the cork, the main shaft 100 is drawn toward the cork past the lock box 200. In particular, the collar 120 of the main shaft 100 is drawn past the protruding portion 220 of the lock box 200. As the collar 120 passes the protruding portion 220, the collar 120 slidably urges against the chamfered bevel 222 to move the protruding portion 220 upward (as depicted in FIGS. 7 and 8), causing the main lever 210 to pivot around the pivot 214 and compress the spring 270 (see FIGS. 7 and 9).

When the collar 120 has moved past the protruding portion 220, the spring 270 urges the main lever 210 to pivot about the pivot 214 so that the protruding portion 220 forcibly urges against the cam 114 on the distal side of the collar 120 (see FIG. 2). The protruding portion 220 hooks over the distal edge of the collar 120. The lateral view angle 224 (see FIG. 7) on the protruding portion 220 is substantially a right angle to resist the lock box 200 from being able to be pulled back over the collar 120 in the opposite direction.

FIG. 8 depicts an end view of the main lever 210 with the protruding portion 220 extending into the aperture 252 of the box housing 250. A central axis of the main shaft 100 (FIG. 2) passes through a center of the aperture 252 in the box housing 250. A line that is normal to the plane of the chamfered bevel 222 and interests the central axis of the main shaft 100, also preferably passes through a central area of the chamfered bevel 222. With this geometric relationship, the chamfered bevel 222 even further facilitates movement of the lock box 200 past the collar 120 as described above.

Figure 6:
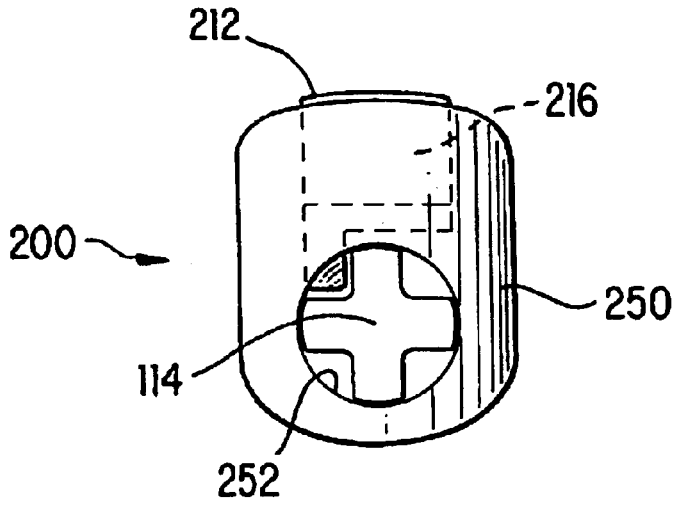
FIG. 6 is a side view of the lock box showing the interaction of the main shaft and the protruding portion.

In FIG. 8, two edges of protruding portion 220 extends into the aperture 252: end edge 226 and side edge 228. The edges 226 and 228 interact with the cam crowns 116 (see FIG. 6) to provide a one way rotational ratchet effect. When the main shaft 100 is rotated in a direction to screw the worm 102 into a cork, the cam crowns 116 slideably urge the end edge 226 in an upward direction (as depicted in FIGS. 6, 7 and 8) causing the button 212 to move down (as depicted in FIG. 7) as the main lever 210 rotates around the pivot 214 and compress the spring 270 (also see FIG. 9). As the main shaft 100 is further turned and the protruding portion 220 passes each cam crown 116, the spring 270 urges the main lever 210 to pivot about the pivot 214 so that the protruding portion 220 returns to its ordinarily lowered position. Thus, the ratchet effect permits the main shaft 100 to rotate in the direction that screws the worm into the cork. However, in contrast, when the main shaft 100 is urged to rotate in the opposite direction to unscrew the worm 102 from the cork, the cam crowns 116 urge against the side edge 228 of the protruding portion 220, but the protruding portion 220 does not move because the lever 216 is not arranged to pivot in that side direction. Thus, the ratchet effect prevents the main shaft 100 from rotating in the direction that unscrews the worm from the cork.

In operation, after the protruding portion 220 has passed the collar 120, as described above, the end and side edges 226 and 228 of the protruding portion 220 interact with the cam crowns 116 of the main shaft 100 to provide the one way rotational ratchet effect.

Figure 10:
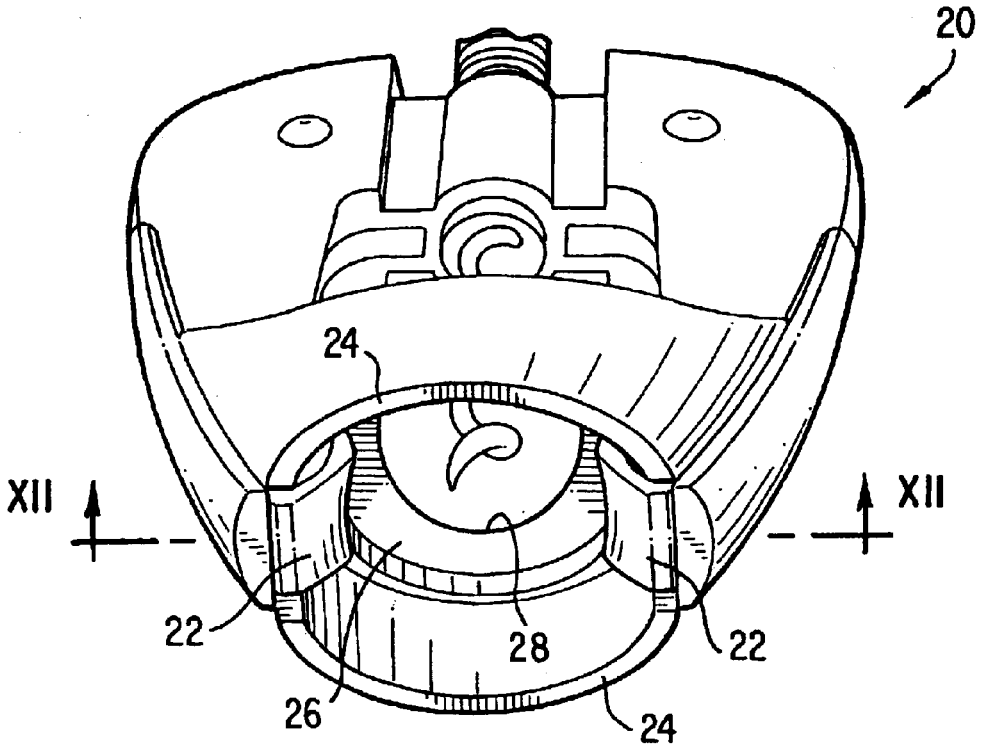
FIG. 10 is a perspective view of the body of the corkscrew.
Figure 11:
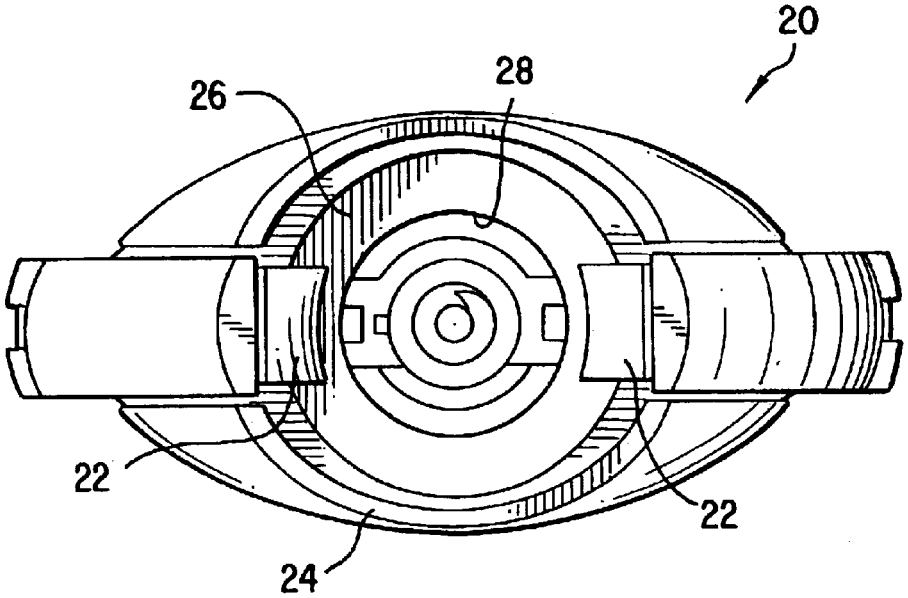
FIG. 11 is a bottom view of the body of the corkscrew.
Figure 12:
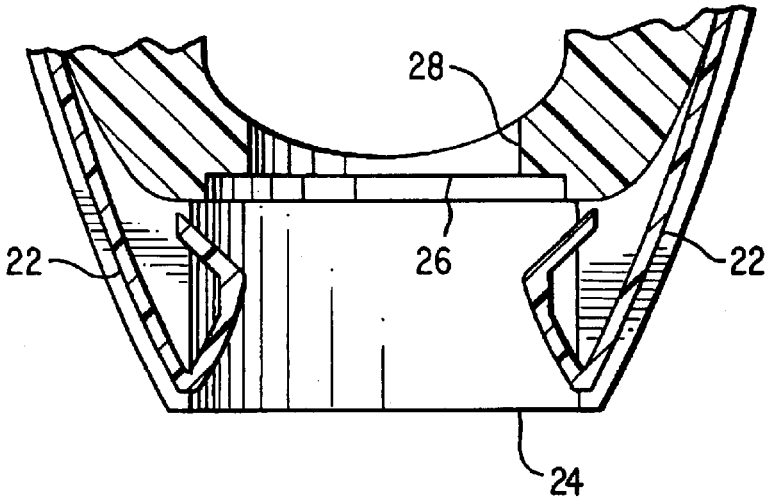
FIG. 12 is a section view of the resilient catches of the corkscrew along the line XII—XII of FIG. 10.

In FIGS. 10-12, the body 20 of the corkscrew also has resilient catches 22 at the end of the corkscrew 10. The catches 22 may be integral with the body 20 or may be formed separately and attached, such as by screws, rivets, bonding adhesives or equivalent. The outer edge 24 of the corkscrew 10 is sized to accept oversize bottle necks, while the catches 22 are fitted to ordinarily accept small bottle necks, but have the flexibility to enlarge to accept large bottle necks. The catches 22 flex outward to hold on to bottle necks of any size and center the bottle necks in the corkscrew 10. When fitted to a bottle, the bottle neck top rests against the shoulder 26, and the worm 102 passes through the bottom aperture 28 to enter the center of the cork of the bottle. The flexing of the catches 22 aligns the worm 102 into the center of the bottle.

In operation, the corkscrew 10 is positioned over the top of a bottle. The resilient catches 22 hold the bottle in the center of corkscrew 10, while flexing to allow bottles of nonstandard size to fit in the corkscrew 10. The top of the bottle stops against the shoulder 26 of the corkscrew 10. The knob 112 of the corkscrew 10 is turned to screw the worm 102 into the cork of the bottle. As the worm 102 is screwed into the cork, the entire main shaft 100 moves downward, moving the teeth 32 of the wings 30 along the ridges 104 of the main shaft 100.

As the worm 102 moves downward, the wings 30 move upward, and the protruding portion 220 of the lock box 200 passes over the ridges 104 until the protruding portion 220 passes over the collar 120 of the main shaft 100. The collar 120 moves slidably along the chamfered bevel 222 to pass the protruding portion 220, until the protruding portion 220 lockingly engages the collar 120.

After the lock box 200 has locked onto the collar 120 of the main shaft 100, the lock box 200 interacts with cam 114 to become a one way rotational ratchet mechanism. The end edge 226 of the protruding portion 220 allows the cam crowns 116 to pass in the rotational direction of turning the worm into the cork, and the side edge 228 of the protruding portion 220 resists the cam crowns 116 from passing in the rotational direction of unscrewing the worm from the cork. Thus, when the lock box 200 is locked, the worm 102 can screw farther into the cork but cannot unscrew or slip out of the cork.

After the lock box 200 is locked and the worm satisfactorily turned into the cork, the wings 30 are closed against the body 20 of the corkscrew 10 to raise the main shaft 100 and the cork out of the bottle. As the wings 30 are closed against the body 20 of the corkscrew 10, the teeth 32 of the wings 30 interact with the ridges 104 of the main shaft 100 to move the entire main shaft 100 and cork upwards. The cork remains on the worm 102 of the main shaft 100 as the main shaft 100 is raised.

After the cork has been removed from the bottle, the cork may be removed from the corkscrew 10 by pressing the button 212 to unlock the lock box 200 from the collar 120. Depressing the button 212 raises the protruding portion 220 from the cam crowns 116 and over the collar 120, allowing the main shaft 100 to freely move axially exposing the cork on the worm. The cork is then easily removed from the worm 102.

Having described preferred embodiments of a novel bottle stopper extractor (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as defined by the appended claims.

Having thus described the invention with the details and particularity required by the patent laws, what is claimed and desired protected by Letters Patent is set forth in the appended claims:

1. A winged corkscrew comprising:

a main shaft that includes a collar;

two wings extending outwardly on opposite sides of an axis defined by the main shaft; and a lock box operable to releaseably engage the collar.

2. The winged corkscrew of claim 1, wherein:

the main shaft further includes a cam distal of the collar; and the lock box is operable to engage the cam so as to form a ratchet relationship.

3. The winged corkscrew of claim 2, further comprising resilient catches, wherein:

the main shaft defines an axis; and the resilient catches have a center aligned with the axis.

4. The winged corkscrew of claim 3, wherein the main shaft further includes a non-stick coated worm.

5. The winged corkscrew of claim 1, further comprising resilient catches, wherein:

the main shaft defines an axis; and the resilient catches have a center aligned with the axis.

6. The winged corkscrew of claim 5, wherein the main shaft further includes a non-stick coated worm.

7. The winged corkscrew of claim 1, wherein the main shaft further includes a non-stick coated worm.

8. The winged corkscrew of claim 1, wherein:

the lock box is able to slide over the collar in a first axial direction to a locked position; and the lock box is stopped from sliding over the collar in a second axial direction.

9. The winged corkscrew of claim 8, wherein the lock box includes a release mechanism to facilitate sliding the lock box from the locked position over the collar in the second axial direction.

10. The winged corkscrew of claim 1, wherein:

the lock box includes a protruding portion that has a chamfered bevel on a distal end and a substantially right angle on a proximal end;

the chamfered bevel is oriented to enable the protruding portion to slide over the collar in a first axial direction; and the substantially right angle is oriented to stop the protruding portion from sliding over the collar in a second axial direction.

11. The winged corkscrew of claim 10, wherein:

the lock box includes a release mechanism coupled to the protruding portion; and actuation of the release mechanism moves the protruding portion so that the protruding portion may slide past the collar in the second axial direction.

12. The winged corkscrew of claim 11, wherein:

the release mechanism includes a lever on which the protruding portion is configured at a distal end; and the lever includes a release button configured at a proximal end and a pivot between the release button and the protruding portion.

13. The winged corkscrew of claim 10, wherein:

the lock box further includes a box housing having an aperture therein;

the protruding portion has an end edge protruding into the aperture and a side edge protruding into the aperture;

the cam includes plural cam crowns;

when the main shaft is urged to rotate relative to the lock box in a first rotational direction, each cam crown in turn urges against the end edge so as to move the protruding out of the aperture and permit the main shaft to be rotated in the first rotational direction; and when the main shaft is urged to rotate relative to the lock box in a second rotational direction, a cam crown urges against the side edge and stops the main shaft from being rotated in the second rotational direction.

14. The winged corkscrew of claim 13, further comprising resilient catches, wherein:

the main shaft defines an axis; and the resilient catches have a center aligned with the axis.

15. The winged corkscrew of claim 14, wherein the main shaft further includes a non-stick coated worm.

16. The winged corkscrew of claim 14, wherein:

the resilient catches have a separation defined by a small bottle neck; and the resilient catches are capable of flexing to accommodate a large bottle neck while maintaining a centered position in alignment with the axis.

17. The winged corkscrew of claim 10, further comprising resilient catches, wherein:

the main shaft defines an axis; and the resilient catches have a center aligned with the axis.

18. The winged corkscrew of claim 17, wherein the main shaft further includes a non-stick coated worm.

19. The winged corkscrew of claim 17, wherein:

the resilient catches have a separation defined by a small bottle neck; and the resilient catches are capable of flexing to accommodate a large bottle neck while maintaining a centered position in alignment with the axis.

20. The winged corkscrew of claim 10, wherein the main shaft further includes a non-stick coated worm.

21. A winged corkscrew comprising:

a main shaft that includes a cam;

two wings extending outwardly on opposite sides of an axis defined by the main shaft; and a lock box operable to engage the cam so as to form a ratchet relationship.

22. The winged corkscrew of claim 21, wherein:

the lock box permits the main shaft to be rotated relative to the lock box in a first rotational direction; and the lock box stops the main shaft from being rotated in a second rotational direction.

23. The winged corkscrew of claim 21, wherein:

the lock box includes a box housing having an aperture therein and a protruding portion having an end edge protruding into the aperture and a side edge protruding into the aperture;

the cam includes plural cam crowns;

when the main shaft is urged to rotate relative to the lock box in a first rotational direction, each cam crown in turn urges against the end edge so as to move the protruding out of the aperture and permit the main shaft to be rotated in the first rotational direction; and when the main shaft is urged to rotate relative to the lock box in a second rotational direction, a cam crown urges against the side edge and stops the main shaft from being rotated in the second rotational direction.

24. A winged corkscrew comprising:

a main shaft that includes a collar defining an axis;

two wings extending outwardly on opposite sides of an axis defined by the main shaft;

a lock box operable to releaseably engage the collar; and resilient catches having a center aligned with the axis.

25. The winged corkscrew of claim 24, wherein:

the resilient catches have a separation defined by a small bottle neck; and the resilient catches are capable of flexing to accommodate a large bottle neck while maintaining a centered position in alignment with the axis.

26. A method of uncorking, the method comprising:

screwing a non-stick worm of a main shaft of a corkscrew onto a cork until a lock box lockingly engages a collar on the main shaft;

continuing screwing until wings of the corkscrew have risen and the non-stick worm is fully inserted into the cork; and lowering the wings of the corkscrew to remove the cork from a bottle neck.

27. The method of claim 26, further comprising:

unlocking the lock box from the collar after the cork is removed from the bottle neck;

sliding the main shaft through the lock box to reveal the removed cork; and twisting the cork off of the worm.

28. The method of claim 26, further comprising aligning the bottle neck with resilient catches of the corkscrew before screwing the non-stick worm into the cork.

29. A winged corkscrew comprising:

a main shaft that includes a collar;

two wings extending outwardly on opposite sides of an axis defined by the main shaft; and means for releasably engaging the collar.

30. The winged corkscrew of claim 29, wherein:

the main shaft further includes a cam; and the means for releasably engaging further includes means for engaging the cam in a ratchet relationship.

31. The winged corkscrew of claim 30, wherein the main shaft defines an axis, the winged corkscrew further comprising means for aligning a center of an opening with the axis.

32. The winged corkscrew of claim 31, wherein the main shaft further includes a non-stick coated worm.

33. A winged corkscrew comprising:

a main shaft includes a cam; and means for engaging the cam in a ratchet relationship.

34. The winged corkscrew of claim 33, wherein the main shaft defines an axis, the winged corkscrew further comprising means for aligning a center of an opening with the axis.

35. The winged corkscrew of claim 34, wherein the main shaft further includes a non-stick coated worm.

* * * * *